United States Patent [19]

McCray et al.

[11] Patent Number: 5,018,887

[45] Date of Patent: May 28, 1991

[54] FORMS FEED TRACTOR HAVING MODIFIED PIN SPACING

[75] Inventors: Charles M. McCray; Brandon S. Nadler; David M. Sedgwick; David M. Traxler, all of Charlotte, N.C.

[73] Assignee: International Business Machines Corporation, Armonk, N.Y.

[21] Appl. No.: 239,159

[22] Filed: Aug. 31, 1982

[51] Int. Cl.[5] ..... B41J 11/30

[52] U.S. Cl. ..... 400/616.1; 400/902

[58] Field of Search ..... 400/616, 616.1, 616.2, 400/616.3, 902; 226/74, 75, 87

[56] References Cited

U.S. PATENT DOCUMENTS

| | | | |
|---|---|---|---|
| 2,122,458 | 7/1938 | Elmer | 226/87 |
| 3,644,812 | 2/1972 | Bitto et al. | 400/902 X |
| 3,744,820 | 7/1973 | Porter | 400/616.1 X |
| 4,005,810 | 2/1977 | Porter | 400/616.3 X |
| 4,226,353 | 10/1980 | Blaskovic et al. | 226/74 |
| 4,400,105 | 8/1983 | Yeager et al. | 400/616.1 |
| 4,453,660 | 6/1984 | Cornell et al. | 226/74 |
| 4,473,179 | 9/1984 | Bauer | 226/74 |
| 4,538,515 | 9/1985 | Tymkewicz et al. | 400/616.1 X |

FOREIGN PATENT DOCUMENTS 1496869 7/1978 United Kingdom .

*Primary Examiner*—Edgar S. Burr
*Assistant Examiner*—John S. Hilten
*Attorney, Agent, or Firm*—Theodore E. Galanthay; William N. Hogg

[57] ABSTRACT

Printers and copiers have paper handling mechanisms that incorporate form feeding tractors to move a continuous form or web having edge holes. It has been discovered that the web can be driven at a high acceleration yet uses a small number of pins by setting the pin pitch of the tractor greater than the pitch of the edge holes.

12 Claims, 4 Drawing Sheets

Fig. 4
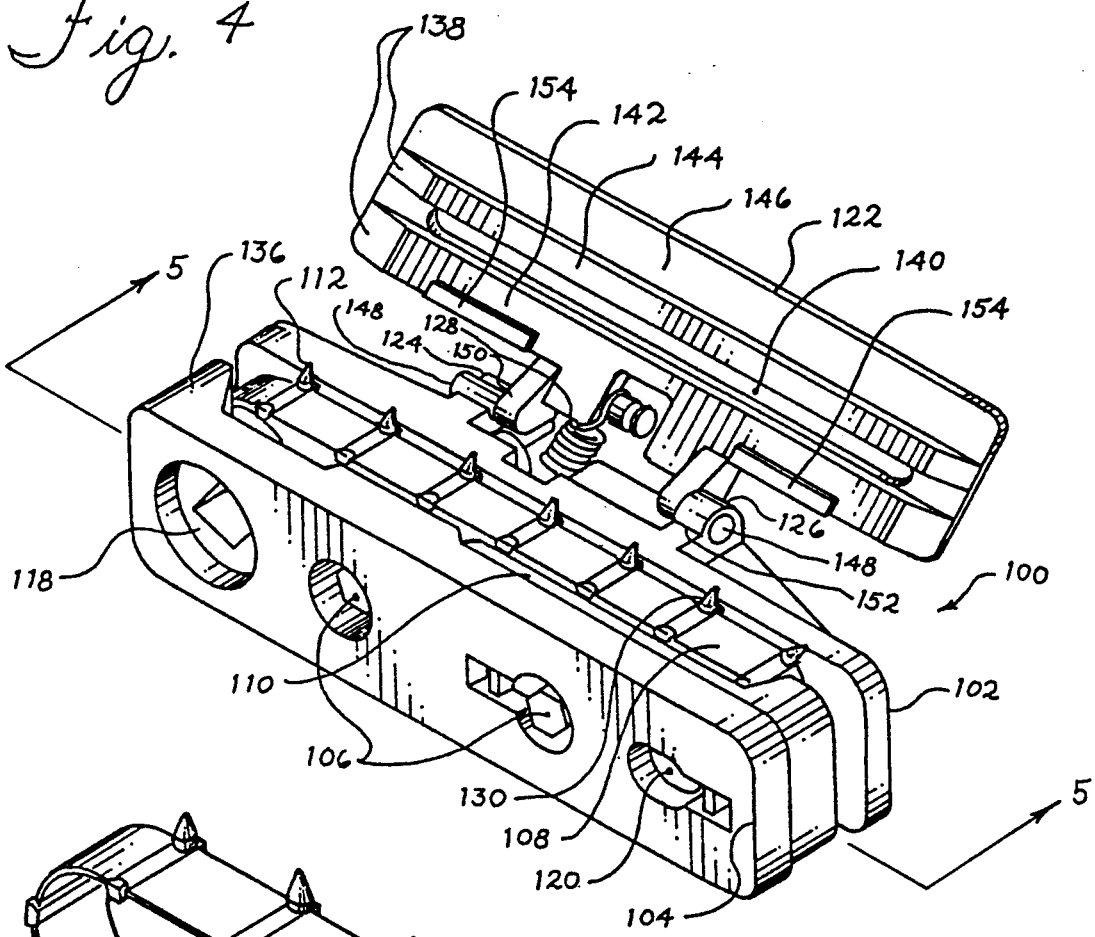
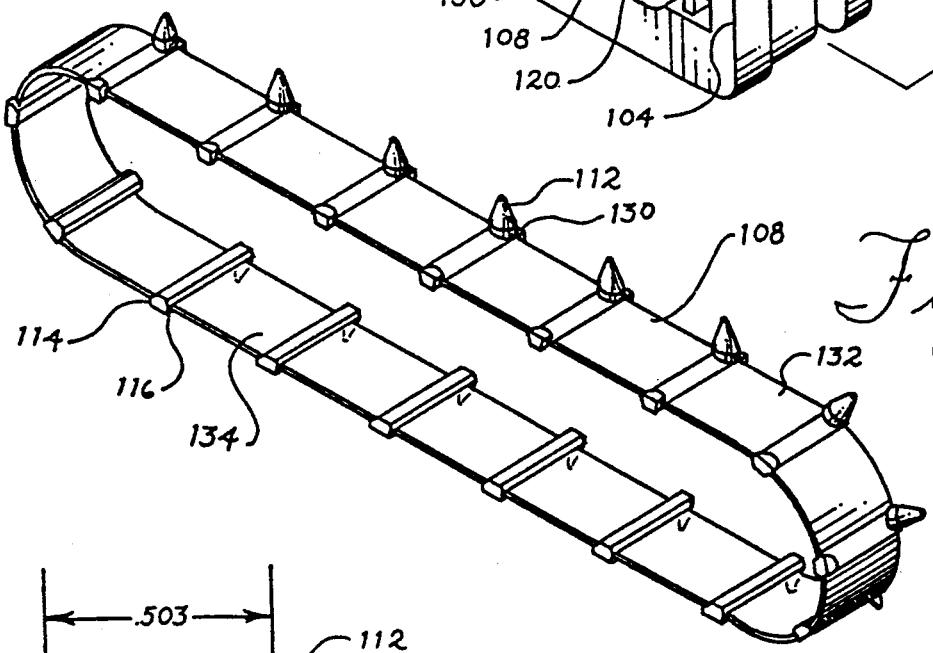
Fig. 6
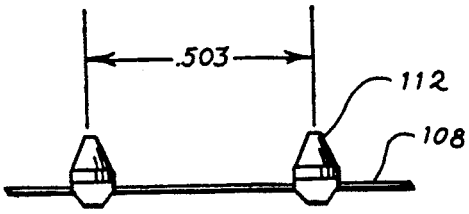
Fig. 10

FORMS FEED TRACTOR HAVING MODIFIED PIN SPACING

BACKGROUND OF THE INVENTION

1. Technical Field

This invention relates to a forms feed tractor for a paper handling apparatus and, more particularly to a continuous forms feed tractor for moving a web or record medium such as paper having edge holes, through a printer, copier or other similar apparatus operating on the record medium. More particularly, the invention relates to pins and belts useful in such paper handling mechanisms.

2. Background Art

In dot band printers, such as the IBM 4234, the continuous forms or web is moved one dot row at a time. The user applications for such a printer require very high through-put rates of 600 lines/minute. This translates into accelerations on the paper of approximately 32,000 inches/second*second. This high rate of acceleration directly relates to a force that is imparted to the form. This force deforms the holes of the forms, the amount of deformation being dependent on how many tractor pins are in contact with the form. It is known that more pins contacting the paper at one time lessens the amount of hole deformation. This, however, requires larger and hence more expensive tractors. Larger tractors require larger motors, more complex electronics and a bigger box to house it in, all of which, results in a more expensive product. Hence, it is highly desirable to use small, light weight, inexpensive tractors while avoiding the hole deformation problem.

SUMMARY OF THE INVENTION

It is a principle object of this invention to provide an economical forms feeding tractor that avoids the problems associated with hole deformation. This and other objectives are achieved by providing a belt for a forms feeding tractor adapted for feeding a record medium having drive holes along at least one edge. The belt comprises a thin flexible band and a plurality of pins affixed to the band and arranged for engaging the drive holes of the record medium. The pins are spaced from one another by a distance greater than the distance between the drive holes of the paper.

BRIEF DESCRIPTION OF THE DRAWINGS

FIG. 4 is a forms feed tractor as shown in FIG. 5 with the door raised;

FIG. 6 is a belt having the unique pin pitch of the invention;

FIG. 10 shows the dimensional relationship between adjacent pins of the belt.

DESCRIPTION OF THE PREFERRED EMBODIMENT

Figure 1A:
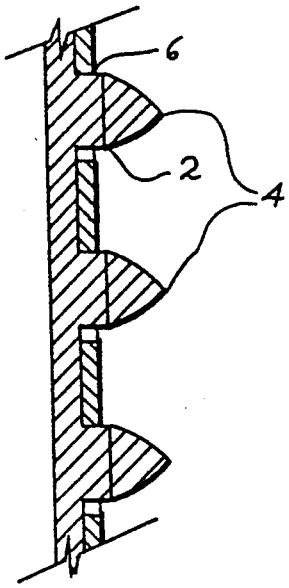
Fig. 1A PRIOR ART
FIGS. 1A and 1B depicts a record medium with undeformed holes and tractor as shown in FIG. 5 pins of the prior art.
Figure 1B:
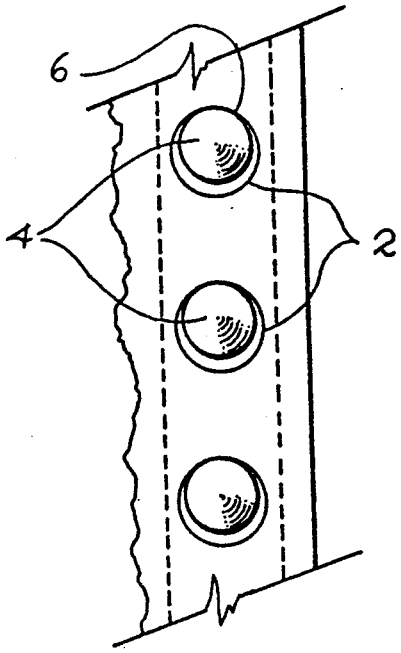
Fig. 1B PRIOR ART

Continuous forms have holes running along both sides which are spaced one-half inch apart. All prior art tractors employing pins to feed forms have spaced the pins one-half inch apart as well. When a large amount of hole deformation is encountered a feeding problem is likely to occur in the paper handling apparatus. FIGS. 1A and 1B depict how normal form holes 2 and tractor pins 4 appear. It should be noted that pin 4 impinges upon hole edge 6 of form hole 2 in the direction the form or record medium web is traveling indicated by the arrow. In paper handling systems that have low acceleration, numerous pins 4 or low forms tension, little hole deformation occurs. Where conditions of high acceleration, few pins 4 or high forms tension exist, hole deformation can be so significant that tractor jams destroy the form 12.

Figure 2A:
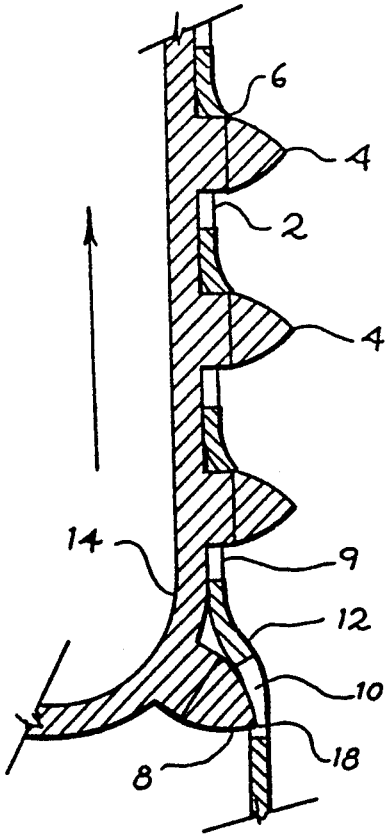
Fig. 2A PRIOR ART
FIGS. 2A and 2B depicts a record medium with holes deformed by the tractor pins.
Figure 2B:
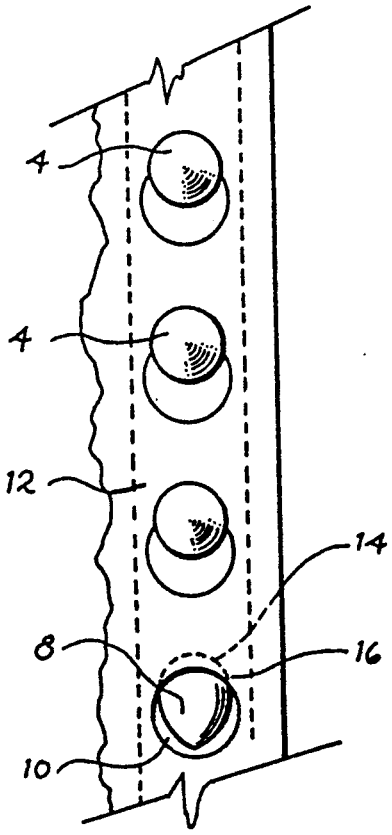
Fig. 2B PRIOR ART

As can be seen in FIG. 2, when significant deformation occurs the form 12 is displaced, in a direction opposite to that of the arrow, by an amount equal to the deformation of each hole 2. A feeding problem occurs when bottom pin 8 attempts to enter undeformed hole 10. Hole 10 would be the hole which is about to enter the tractor 20. With the forms 12 displaced by the amount of deformation, pin 8 strikes the form 12 ahead of the hole 10. In the prior art, the pitch of the tractor pins 4 is always one-half inch, but the pitch of the last deformed form hole 9 and the new undeformed hole 10 about to enter the tractor 20 is greater than one-half inch by the amount of deformation, shown in FIG. 2 as the distance between pin base 14 and edge 16 of hole 10. When pin 8 interferes with the form 12 two things happen. First, the pin 8 deforms the hole 10; and second, the pin 8 pushes the form 12 upward, away from pin base 14 and toward tip 18. The combination of hole deformation and pushed up form 12 creates a condition leading to a paper jam in the form feeding apparatus.

A principle of this invention is to increase the pin pitch of the tractor 20 to compensate for the deformation of the form's holes 10 so that the pin 8 does not interfere with the new hole 10 coming into the tractor 20. Increasing the pin pitch does not change the amount of hole deformation experienced by the form 12, it simply allows the pin 8 to enter the form's hole without interference.

Figure 3:
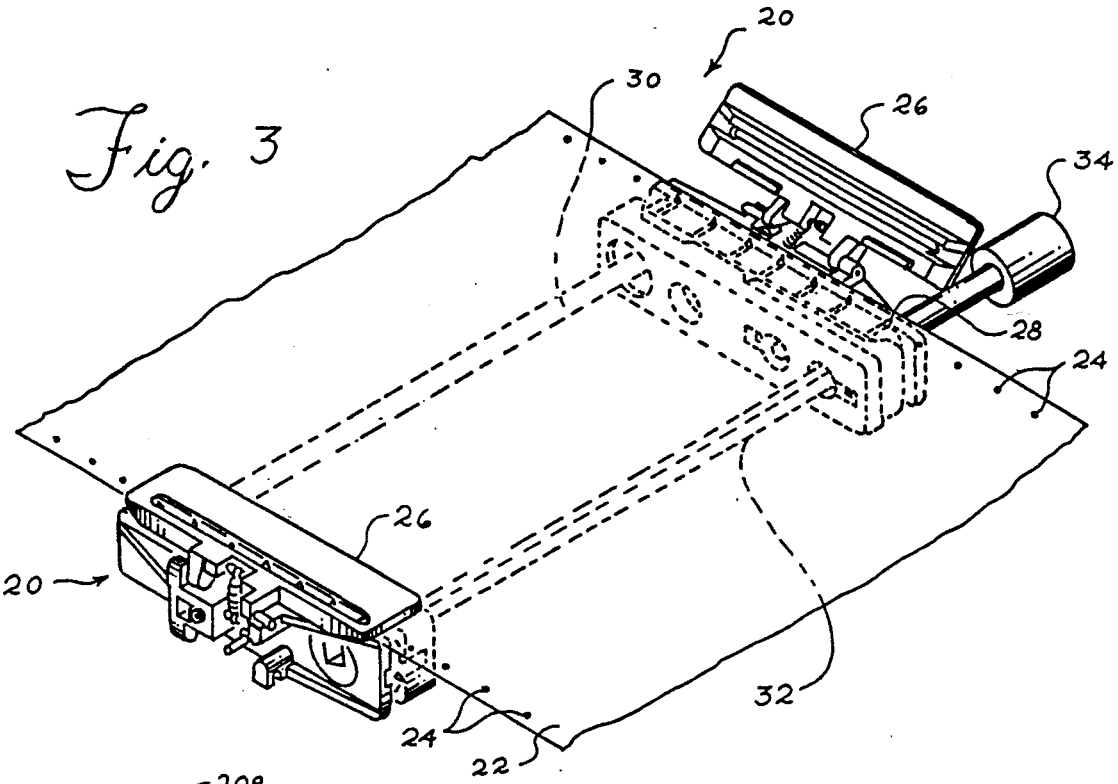
FIG. 3 shows a pair of forms feed tractors as part of a paper handling system.

Referring to FIG. 3, a pair of forms feed tractors 20 are shown as they would be mounted in a paper handling apparatus such as would be used in printer or copier. Web 22 is shown as conventional computer paper having edge holes 24, however, web 22 could also be multi-part continuous forms or other material for forming images on the surface thereof. The web 22 is loaded into the tractors 20 by opening the hinged door 26, placing the web perforations or holes 24 over the drive pins 28, and closing the door 26. Web 22 is driven by pins 28 of forms feed tractor 20 which engage the web 22 at edge holes 24. The web 22 is pressed onto the pins 28 by door 26 also known as a lid. In other embodiments, there can be a gap as is known in the prior art. Tractor 20 is held in position by means of guide shaft 30 and drive shaft 32. The pins 28 of tractor 20 are rotated in either a forward or reverse direction by drive shaft 32 which is driven by a suitable drive means 34 such as either a stepper motor or DC servo motor.

Referring to FIGS. 4 and 6, a form feed tractor 100 has an outer side frame 102 and an inner side frame 104.

The two side frames 102 and 104 are held together by locking member 106. Belt 108 is mounted between frames 102 and 104 and rides along a shoulder 110. Belt 108 has pins 112, and drive teeth 114 which are affixed to belt 108 at drive tooth base 116. Drive shaft aperture 118 and guide shaft aperture 120 are for receiving drive shaft 32 and guide shaft 30 (FIG. 3) respectively. Door 122 is mounted on outer side frame 102 at hinges 124 and 126 with spring 128 provided to maintain pressure on the record medium or web 22 so that the forms 12 (shown in FIG. 2) are positioned near base 130 of pin 112.

Still referring to FIG. 4, the tractor door 122 is generally of the same size as tractor guiding surface 136. The body of the door 122 is generally flat, or as shown in the Figure, includes a pair of ribs 138 extending downwardly therefrom, generally aligned and coextensive with the track of the pins 112 or the guiding surface 136. In this embodiment, one rib 138 is disposed on each side of the pins 112 and together they define a slot 140 along which the pins 112 move. The lower guiding surfaces 142 and 144 of the ribs 138 are smooth to avoid snagging the web 22.

Door 122 is connected to the outer side frame 102 by a pair of outwardly extending arms 150 with perpendicular protruding hinge pins 148 that are pivotally received in cradle 124 and bracket 152. An extension spring 128 has opposite ends stretched between door 122 and outer side frame 102 to hold door 122 in either its open loading position (FIG. 4) or in its closed driving position (FIG. 3). The door 122, when closed, is spaced from guiding surface 136 by a pair of stops 154.

Figure 5:
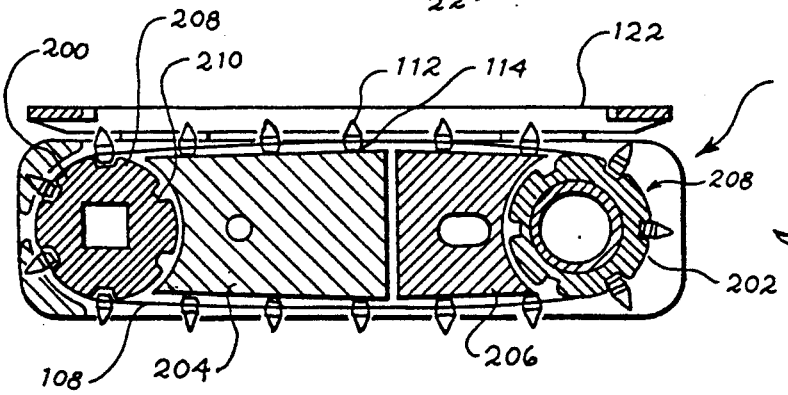
FIG. 5 is a cut-away view of the forms feed tractor of FIG. 4 taken along the line 5—5.

Referring to FIG. 6, endless belt 108 is typically a strip of non-stretchable polyimide film, such as Kapton. In other embodiments the belt 108 may be constructed of a polymer such as polyester. It includes a plurality of attached, uniformly spaced drive pins 112 that extend outwardly from the outer belt surface 132. In this invention that spacing should be 0.503", on centers, see FIG. 10. Drive teeth 114 may be integrally formed with the drive pin 112, and extend inwardly from the inner belt surface 134. Each drive tooth 114 has a cross sectional configuration that is complementary to the configuration of the axial slots 210 of the sprockets 200 and 202 (FIG. 5).

Whereas, the preferred embodiment calls for a pin pitch of at least 0.503 inches, different embodiments might require different pin pitches. The appropriate pin pitch for a particular application is selected based on the amount of hole deformation. Because hole deformation is a function of many things such as acceleration, number of pins engaged and forms tension it is necessary to run tests to determine the relative performance of several pin pitches.

A test was devised whereby a paper handling apparatus having a specific number of pins, in this case fifteen, was run using belts with varying length corresponding to different pin pitches. The prior art would call for a 7.5 inch belt when using fifteen pins. The machines performance was rated using the following criteria: Rated 0 if failed before printing one sheet; rated 1 if failed before printing five sheets; rated 2 if failed before printing ten sheets; rated 3 if failed before printing 500 sheets; rated 4 if did not fail within eight hours but showed evidence of hole deformation; and, rated 5 if no failure or hole deformation within an eight hour period. An example showing the average machine performance for various pin pitches is displayed in Table A.

TABLE A

| BELT LENGTH (INCHES) | AVERAGE PERFORMANCE |
|---|---|
| 7.475 | 2.0 |
| 7.480 | 2.9 |
| 7.485 | 3.0 |
| 7.490 | 3.1 |
| 7.495 | 3.6 |
| 7.500 | 3.7 |
| 7.505 | 3.8 |
| 7.510 | 3.9 |
| 7.515 | 4.0 |
| 7.520 | 4.1 |
| 7.525 | 4.1 |
| 7.530 | 4.6 |
| 7.535 | 4.8 |
| 7.540 | 4.7 |
| 7.545 | 5.0 |
| 7.550 | 5.0 |
| 7.555 | 5.0 |
| 7.560 | 5.0 |

Referring to FIG. 5, tractor 20 is shown with lid 122 in a closed position. Belt 108 travels along a belt path defined by drive sprocket 200, idler sprocket 202 and ramps 204 and 206. Drive sprocket 200 and idler sprocket 202 have cogs 208 and slots 210. Drive teeth 114 of belt 108 fit in slots 210 and, as drive sprocket 200 is driven by drive shaft 32 and suitable motor means 34 (FIG. 3) belt 108 is caused to turn driving the web 22 through the paper handling mechanism.

Figure 7:
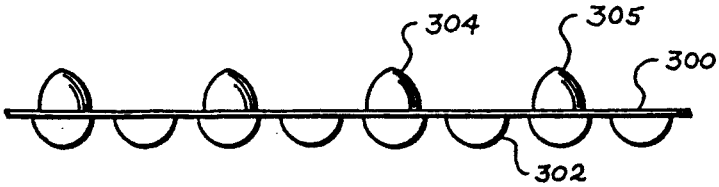
FIGS. 7 through 9 are different embodiments of tractor belts incorporating the invention.
Figure 8:
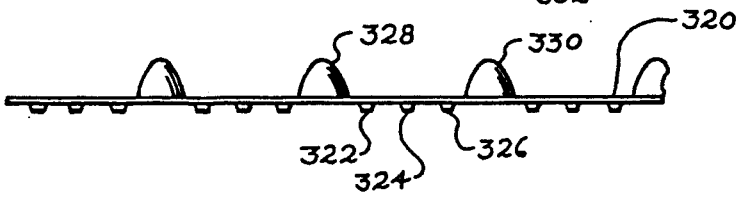
Figure 9:
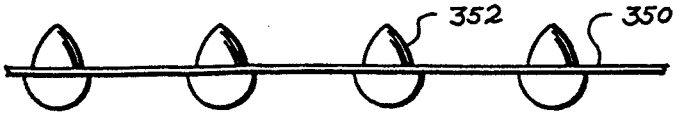

FIGS. 7, 8 and 9 show belts having different pin/-drive tooth profiles. FIG. 7 shows a belt 300 having a separate drive tooth 302 between adjacent pins 304, 305. FIG. 8 shows a belt 320 formed of molded rubber having three drive teeth 322, 324, 326 formed between adjacent pins 328, 330. FIG. 9 shows a belt 350 with each pin/drive tooth 352 formed by injection molding the pin/drive tooth 352 through belt 350. The present invention can be employed regardless of pin profile, number of drive teeth or manufacturing method. The critical factor is to make the pin pitch greater than the pitch of the form holes.

Figure 11A:
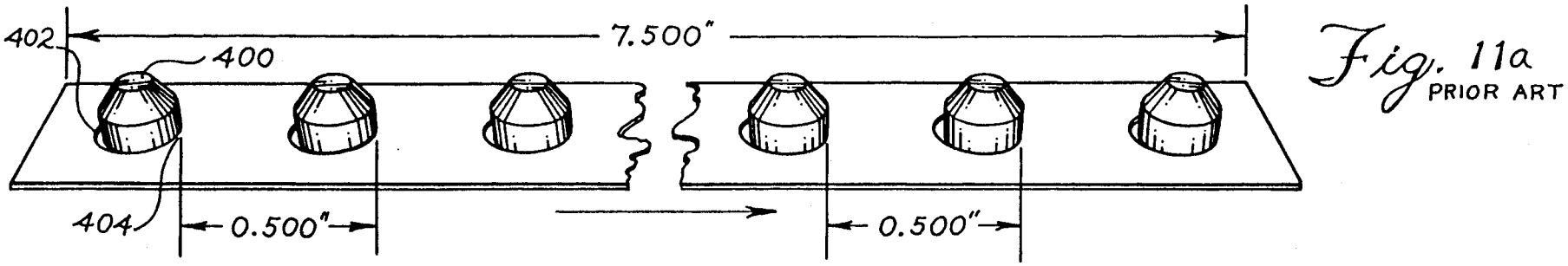
Fig. 11a PRIOR ART
FIGS. 11A, 11B and 11C illustrate the operation of the pins of the prior art and present invention.
Figure 11B:
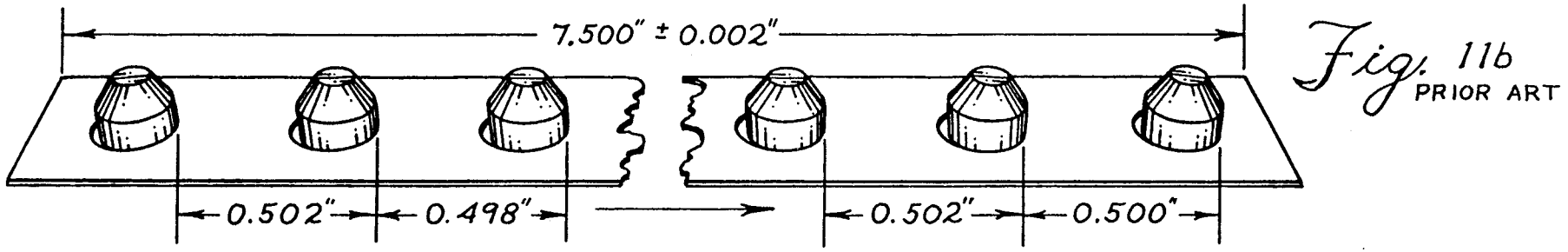
Fig. 11b PRIOR ART
Figure 11C:
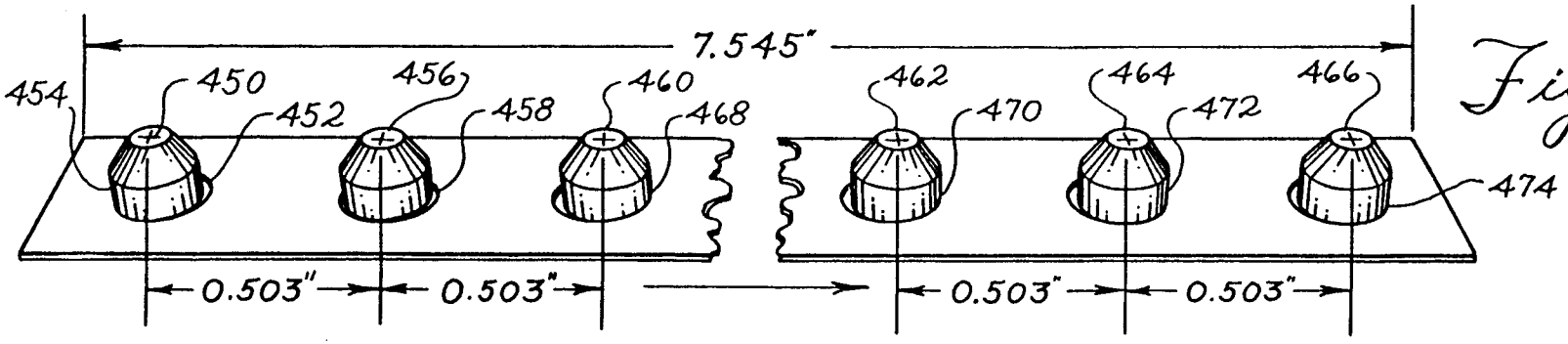

Referring to FIGS. 11A, 11B and 11C, the operative principles of this invention will be explained. In FIG. 11A, a forms hole spacing of 0.500" is shown with tractor pins 400 also spaced at 0.500". (It should be noted that the pins 400 and forms 22 of FIGS. 11A, 11B and 11C are being fed in the direction shown by the arrow). Each pin 400 impinges on the forward edge 404 of each hole 402. FIG. 11B shows the belt 108 of FIG. 11B with standard tolerances of 0.002" non-cummulative. A non-cummulating tolerance means that over the entire belt length, the cummulative error may not exceed the specified tolerance. FIG. 11C shows the present invention with the spacing of pins on a belt 108 at 0.503" and that the cummulative length of the belt 108, based on a fifteen pin belt, would be 7.545". FIG. 11C also shows how pin 450, in hole 452, abuts against the trailing edge 454 whereas in the prior art (FIG. 11A or 11B) the pin 400 strikes the leading edge 404. As the form 12 moves through the tractor 20 the pin 450 migrates in the hole 452. See pin 456 and hole 458. Finally, pins 460, 462, 464 and 466 strike the respective leading edges 468, 470, 472 and 474 thus driving the form 12.

The general construction of the tractor and belt has been disclosed in sufficient detail to describe the present invention. For additional information, the reader is referred to U.S. Pat. Nos. 4,226,353 to Blaskovic et al. for Forms Feed Tractor and 4,453,660 to Cornell et al. for Forms Feed Tractor; the application for U.S. Patent filed Jun. 22, 1988 with inventors J. K. Howes and J. H. Paterra for Forms Feed Tractor. These patents are commonly owned by the assignee of the present invention and are specifically incorporated herein by reference.

From the foregoing description, it will be understood by those having skill in the art that according to the present invention a forms feed tractor having a belt with a pin pitch greater than the drive hole pitch of a continuous form provides for improved forms feeding.

While the invention has been particularly shown and described with reference to a preferred embodiment, it will be understood by those skilled in the art that various other changes in form and detail may be made without departing from the spirit and scope of the invention.

We claim:

1. A belt for a forms feed tractor for feeding a record medium having equidistant spaced drive holes, said drive holes having leading and trailing edges, along at least one edge thereof, along a path said belt comprising:

a thin flexible band; and a plurality of pins, leading edges on said pins, said pins affixed to said band and arranged for engaging and disengaging said drive holes of said record medium for advancing said record medium along a path means to prevent excessive deformation of said holes by said pins, said means including the leading edges of, said pins being spaced from one another by distance greater than the distance between the leading edges of said drive holes said pins having a crossectional shape, in a plane parallel to and in engagement with said record medium which is substantially the same shape as the shape of said holes but smaller in size so that one of said pins first engages one of said record medium's drive holes at said drive hole's trailing edge, said pin spacing relative to the spacing of said drive holes resulting in said pin migrating forward in said drive hole along a record medium's path so that said pin is in engagement with the leading edge of said drive hole prior to said pin disengaging said drive hole.

2. The belt of claim 1 wherein the distance between the leading edges of each of said pins is greater than 0.500 inches.

3. The belt of claim 1 wherein the distance between the leading edges of said pins is greater than 0.503 inches.

4. A forms feed tractor for advancing a record medium, said record medium having a plurality of uniform drive holes, with equidistant centers, along an edge thereof, said feed tractor comprising: mounting means; a drive shaft; a drive sprocket rotatably mounted in said mounting means and drivingly engaging said drive shaft; and an endless flexible belt, in driven engagement with said drive sprocket, having a plurality of pins, leading edges on said pins, said pins aligned in a row arranged for engaging said plurality of equidistant spaced drive holes of said record medium, means to prevent excessive deformation of said holes by said pins, said means including the leading edges of said pins in said row spaced apart by a distance that is greater than the distance separating said drive hole's centers of said record medium said pins having a crossectional shape, in a plane parallel to and in engagement with said record medium which is substantially the same shape as the shape of said holes but smaller in size.

5. The forms feed tractor of claim 4 wherein the distance between the leading edges of each of said pins is greater than 0.500 inches.

6. The forms feed tractor of claim 4 wherein the distance between the leading edges of each of said pins is greater than 0.503 inches.

7. A paper handling apparatus for a printer or the like comprising:

a pair of mounting means having a guide shaft mounted therebetween;

at least one pair of forms feeding tractors, mounted on said guide shafts between said mounting means, for feeding a continuous form having a plurality of equidistant spaced drive holes;

each of said tractors having a frame, a sprocket mounted in said frame for drivingly engaging a drive shaft, and a belt in driven engagement with said sprocket having a plurality of pins, leading edges on said pins, said pins engaging said drive holes, means to prevent excessive deformation of said holes by said pins, said means including the leading edges of said pins being separated by a distance greater than said equidistant spacing of;

said drive holes;

said pins having a crossectional shape, in a plane parallel to and in engagement with said record medium which is substantially the same shape as the shape of said holes but smaller in size;

and, a drive means coupled to said drive shaft for driving said drive shaft.

8. The paper handling apparatus of claim 7 wherein said drive hole equidistant spacing is equal to 0.500 inches and each of the leading edges of said pins being separated by a distance greater than 0.500 inches.

9. The paper handling apparatus of claim 7 wherein said drive hole equidistant spacing is equal to 0.500 inches and each of the leading edges of said pins being separated by a distance greater than 0.503 inches.

10. The paper handling apparatus of claim 7 wherein said drive means is a stepper motor.

11. The paper handling apparatus of claim 7 wherein said drive means is a DC servo motor.

12. A printer having a paper handling mechanism including a belt for a forms feeding tractor for feeding a record medium having drive holes along at least one edge thereof, said belt further comprising a thin flexible band and a plurality of pins, leading edges on said pins, said pins affixed to said band and arranged for engaging said drive holes of said record medium, means to prevent excessive deformation of said holes by said pins, said means including the leading edges of said pins being spaced from one another by a distance greater than the distance between said drive holes, said pins having a crossectional shape, in a plane parallel and in engagement to said record medium which is the same shape as the shape of said holes but smaller in size.

* * * * *